United States Patent [19]

Cracknell et al.

[11] Patent Number: 4,761,622

[45] Date of Patent: Aug. 2, 1988

[54] WAVEGUIDE SWITCHING APPARATUS

[75] Inventors: David J. Cracknell, Writtle; Raymond P. Smith, Billericay, both of United Kingdom

[73] Assignee: The General Electric Company, p.l.c., London, United Kingdom

[21] Appl. No.: 924,659

[22] Filed: Oct. 30, 1986

[30] Foreign Application Priority Data

Oct. 31, 1985 [GB] United Kingdom ..... 8526909

[51] Int. Cl.[4] ..... H01P 1/10

[52] U.S. Cl. ..... 333/106; 333/108; 200/153 S

[58] Field of Search ..... 333/105–108; 200/153 S

[56] References Cited

U.S. PATENT DOCUMENTS

| | | | |
|---|---|---|---|
| 2,912,694 | 11/1959 | Phillips, Jr. | 333/106 X |
| 3,155,923 | 11/1964 | Persson | 333/106 X |
| 3,243,733 | 3/1966 | Hosman | 333/106 |
| 4,201,963 | 5/1980 | Welti | 333/106 |

OTHER PUBLICATIONS

Long, *A High-Speed K-Band Switch,* Proc. of the I.R.E., Dec. 1951, pp. 1566, 1567.

Kiely, *A New Type of Waveguide Rotary Switch,* Jrnl. of the British Institution of Radio Engineers, Feb. 1953, pp. 100–103.

*Primary Examiner*—Paul Gensler

*Attorney, Agent, or Firm*—Spencer & Frank

[57] ABSTRACT

Waveguide switching apparatus includes a stator and a rotor arranged to rotate relative to it. The rotor includes passages therethrough arranged to make connections between channels in the stator depending on the relative position of the rotor and stator. One passage is defined partly by the rotor and partly by the stator. This reduces the inertia of the rotor compared with a conventional switch in which all passages are entirely contained within the rotor, and thus improves switching accuracy. A passage in the rotor may have a dimension, in a plane transverse to the axis of rotation, which varies along its length, being smallest at its mid-length. Curved passages in the rotor may be arranged such that tangents to their center lines at their ports are non-radial. This enables the diameter of the rotor to be smaller than would otherwise be required. In another aspect of the invention, an asymmetric circumferential slot arrangment is included in the rotor.

38 Claims, 8 Drawing Sheets

WAVEGUIDE SWITCHING APPARATUS

BACKGROUND OF THE INVENTION

This invention relates to waveguide switching apparatus, and more particularly to switching apparatus used in high power microwave energy arrangements.

A simple known waveguide switch, which may be termed an "S" switch, is illustrated in FIG. 1, which is a transverse section through the stator and rotor of a switch, and FIG. 2, which is a longitudinal section through the rotor and bearings. The switch comprises the rotor 1, which is generally cylindrical in form, and which is arranged to rotate on bearings 2 in the stator 3. Four waveguide channels 4, 5, 6 and 7 are located within the stator 3 and provide passages along which microwave energy may be transmitted. Each of the waveguide channels 4, 5, 6 and 7 terminates at a port A, B, C and D respectively, which is arranged adjacent to the rotor 1, the ports A, B, C, D lying in the same plane and being arranged at 90° intervals around the rotor 1. The rotor 1 includes two curved passages 8 and 9 located within it which are arranged such that their openings at the rotor surface are spaced at 90° intervals. In the orientation shown in FIG. 1, no interconnections are made between the ports A, B, C and D in the stator 3. However, if the rotor 1 is rotated through 45° in a clockwise direction, ports A and B, and ports C and D become interconnected. If the rotor 1 were to be rotated anti-clockwise through 45° from the illustrated position, then ports A and D would be interconnected, and ports B and C interconnected. Thus, for example, energy transmitted along waveguide channel 4 may be switched into channel 5 or channel 7 depending on the orientation of the rotor 1.

An arrangement in which "S" switches are used is illustrated in FIG. 3, which is a schematic diagram of an amplifying stage employed in a satellite. The arrangement comprises five amplifiers 10, 11, 12, 13 and 14, which are arranged to amplify high power microwave signals applied to them on input lines 15, 16, 17, 18 and 19. Two spare amplifiers, 20 and 21, are also included in the arrangement. A plurality of "S" switches 22 are included and are arranged so that, if one of the amplifiers 10 to 14 fails, one of the spare amplifiers 20 and 21 may be switched into the circuit in its place. As can be seen, a large number of "S" switches, in this case twenty, are required to ensure that a failure in any two of the five amplifiers 10 to 14 can be compensated for by switching in the spare amplifiers 20 and 21. Failure of any two amplifiers in this configuration will require the operation of four switches to switch in the two spare amplifiers. For example, if a failure were to occur in amplifier 12, then switches 23 and 24 must be rotated through 90° to switch the applied signal on line 17 through the spare amplifier 20. If another failure occurs, for example, if the amplifier 13 were to fail, then the rotors of switches 25 and 26 must be rotated through 90° to switch the signal on line 18 to the spare amplifier 21.

Another type of waveguide switch, which may be termed an "R" switch, is illustrated in FIG. 4, which is a transverse section through the stator and rotor of such a switch, and FIG. 5, which is a longitudinal section through the rotor and bearings. The "R" switch is similar to the "S" switch described with reference to FIGS. 1 and 2, in that it includes two curved passages 27 and 28 within the rotor 29. In addition, the rotor 29 also includes a further passage 30, which is straight and is arranged between the curved passages 27 and 28, along a diameter of the rotor 29. This configuration permits a larger variety of interconnections to be made between four waveguide channels 31, 32, 33 and 34 located within the stator 35, and having ports A, B, C and D respectively, than is possible with an "S" type switch. In the position illustrated in FIG. 4, ports B and D only are interconnected. If the rotor 29 is rotated through 45° clockwise from the position shown, then ports A and B are interconnected, and ports C and D interconnected, by the curved passages 27 and 28 respectively. Similarly, ports B and C may be connected, and ports A and D, if the rotor is rotated through 45° anti-clockwise from the illustrated position. Therefore, in a particular arrangement, fewer switches may need to be included if they are "R" type switches rather than "S" type switches. However, although an arrangement using "R" switches may include fewer switches, a greater number of switching operations tend to be necessary if failure occurs. The essential reliability of the switches depends on the number of switching operations which are required to effect a desired path change and it is desirable, therefore, especially in applications where failure cannot easily be rectified, that a minimum number of switching operations are employed.

Another waveguide switch, which may be termed a "T" switch, is illustrated in FIGS. 6 and 7, which are transverse and longitudinal sections respectively through the rotor 36 of such a switch. The "T" switch is similar to the "R" switch, in that it includes two curved passages 37 and 38 through the rotor and a straight passage 39 across a diameter of the rotor. In addition, another passage is also included to provide a connection orthogonal to that provided by the straight passage 39. The additional passage is a cross-under passage 40 which has ports in the same plane as the other passages in the rotor 36, but which passes underneath them, as shown in FIG. 7. This type of switch enables a greater variety of interconnections to be made than does either an "S" or an "R" switch. Thus, where "T" switches are included, in an amplifying section for example similar to that shown in FIG. 3, the same number of switches are required as would be necessary if "R" switches were to be used and the number of switching operations necessary to include spare amplifiers in the circuit is the same as in an arrangement which uses "S" type switches. However, a "T" type switch is much larger than either an "S" or "R" type switch having similar sized channels, and requires a thicker rotor of larger diameter to accommodate the four passages. This increases the inertia of the rotor considerably, which has the disadvantage that switching accuracy may be reduced and greater torque is required for the switch to be operated. Also heating effects associated with the "T" switch dictate that a large spacing be left between the rotor and stator to allow for expansion. This may result in an unacceptable degree of leakage where the waveguide channels feed into the passages in the rotor.

SUMMARY OF THE INVENTION

This invention seeks to provide improved waveguide switching apparatus.

According to a first aspect of the invention there is provided waveguide switching apparatus comprising first and second members arranged to undergo relative rotation, there being first and second channels in the second member having respective ports at a boundary between the first and second members, the arrangement and construction of the two members being such that, when in a particular position relative to one another, they define a passage between the ports which connects the channels and which is located partly in the first member and partly in the second member. Thus a waveguide switch in accordance with the invention may be arranged to have a relatively small moment of inertia, since one of the members which defines part of the passage is not required to rotate. Also, since the first member may be smaller than would be possible for a previously known member in which the whole of a similar size passage between ports is located within it, expansion due to heating effects is correspondingly reduced and thus the spacing between the first and second members may be smaller. Apparatus in accordance with the invention is particularly advantageous in switching apparatus in which one passage is arranged to cross under another channel, such as in a "T" type switch for example. Although, most advantageously, the first member is generally cylindrical, it could be some other convenient configuration.

According to a second aspect of the invention there is provided waveguide switching apparatus comprising a rotor and a stator arranged to undergo relative rotation, there being a waveguide passage in the rotor, the passage having a transverse dimension which is non-constant along its length in a plane transverse to the axis of rotation of the rotor.

It is preferred that the transverse dimension of the passage is larger at its ports at the surface of the rotor than mid-way between them. This is particularly advantageous in a switch in which it is desired to have a central through passage along a diameter of a rotor and curved passages on either side, for example, as in an "R" or "T" type switch, a curved waveguide passage being curved in the plane in which the transverse dimension is non-constant. By employing the invention, the overall diameter of the rotor may be reduced compared to that which would otherwise be necessary and hence inertia is reduced and switching accuracy of the switch may be improved. The transverse dimension may vary in steps or smoothly. A second waveguide passage may be included and arranged orthogonal to the first-mentioned passage.

According to a third aspect of the invention, there is provided waveguide switching apparatus comprising a rotor arranged to rotate relative to a stator, there being included in the rotor a curved waveguide passage arranged such that tangents to its centre-line at ports extend non-radially, whereby it encompasses a larger area of the rotor than if said tangents were to extend radially. Preferably the curved passage is part of a circle. Thus, instead of tangents intersecting at the axis of rotation, as is conventional, they intersect beyond it. Where such a curved passage is included, it enables a rotor of a "T" switch, for example, to have a smaller diameter than that of a conventional rotor whilst still enabling a passage to be accommodated in the area of the rotor which it encompasses.

According to a fourth aspect of the invention, there is provided waveguide switching apparatus comprising a rotor, having at least one waveguide passage therethrough, arranged to rotate relative to a stator, having a plurality of waveguide channels therein, connection via the passage being made between respective waveguide channels depending on the relative position of the rotor and the stator, and a circumferential slot arrangement being included in a surface of the rotor in which ports of the passage are located, said arrangement being asymmetric about the centre plane of the rotor transverse to its axis of rotation. By employing an asymmetric arrangement, for example by including more slots on one side of the centre plane and/or by having different spacings between them, the microwave properties of the device can be arranged to present substantially symmetrical conditions to microwave energy propagated along the passages even if the rotor, for example, is physically asymmetric. One or more circumferential slots may be included in the arrangement, and may be continuous or extend round only part of the surface. Typically the rotor is generally cylindrical and the or each circumferential slot of the arrangement is a groove extending completely around its curved surface.

Preferably, the rotor is arranged to rotate in bearing means including first bearings located at a greater distance from the centre plane of the rotor transverse of the axis of rotation compared to second bearings located on the other side of said plane. This is a particularly advantageous arrangement as it permits, for example, actuator means for moving the rotor to be located between the first bearings and the transverse centre plane, substantially without detriment to the microwave properties of the device and reducing mechanical stresses in the device.

According to a feature of the invention, a microwave amplifying arrangement includes waveguide switching apparatus in accordance with the invention, this being particularly suitable in satellite applications, for example.

BRIEF DESCRIPTION OF DRAWINGS

The invention is now further described by way of example with reference to FIGS. 8 to 15 of the accompanying drawings, in which.

DESCRIPTION OF PREFERRED EMBODIMENTS

Figure 1:
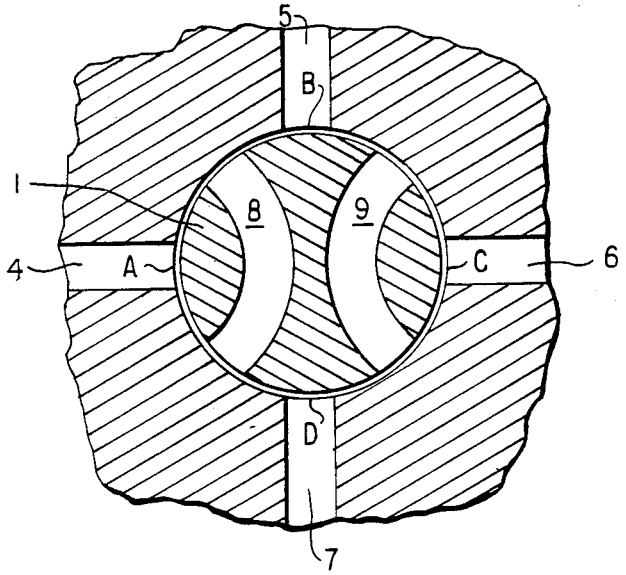
FIG. 1 (PRIOR ART)
FIGS. 1 to 7 are referred to above.
Figure 2:
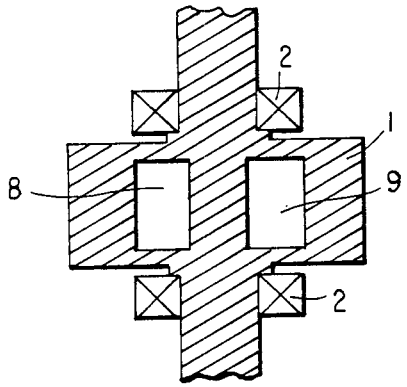
FIG. 2 (PRIOR ART)
Figure 3:
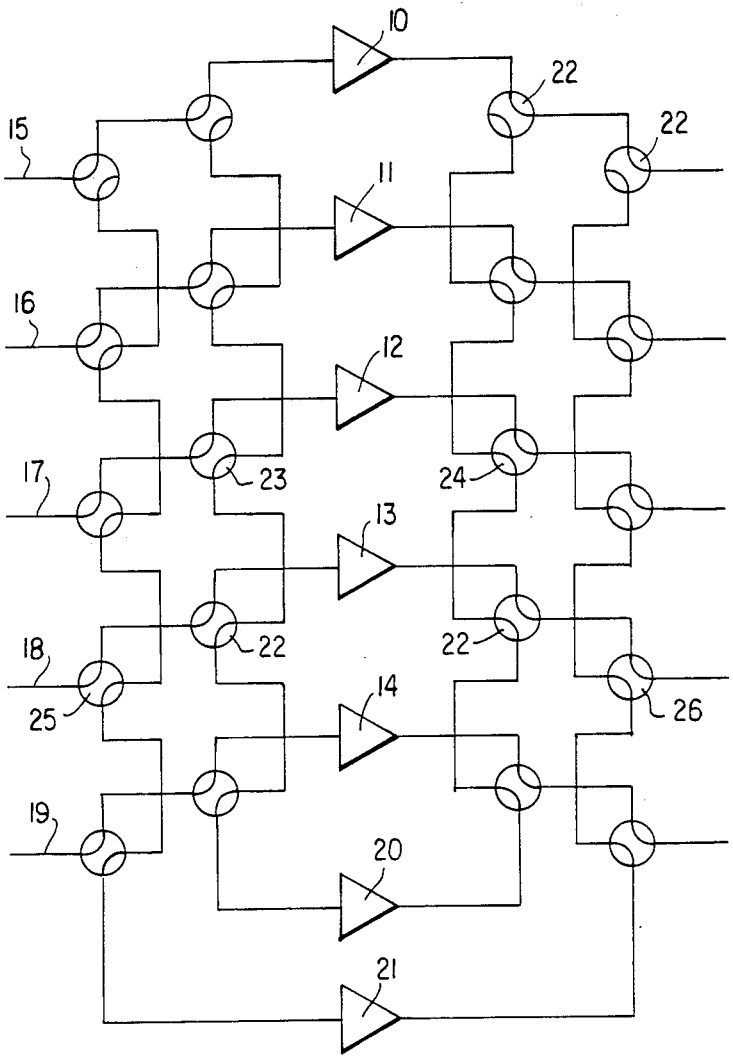
FIG. 3 (PRIOR ART)
Figure 4:
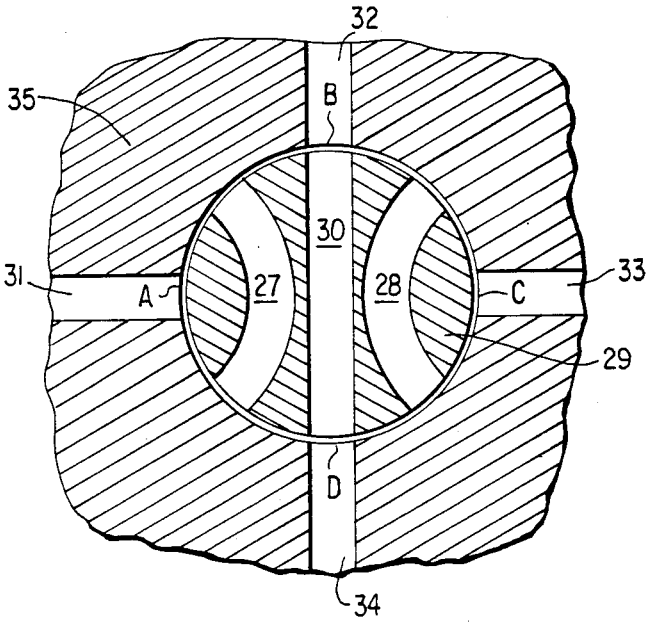
FIG. 4 (PRIOR ART)
Figure 5:
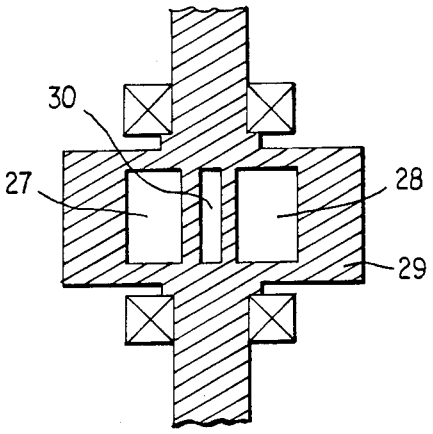
FIG. 5 (PRIOR ART)
Figure 6:
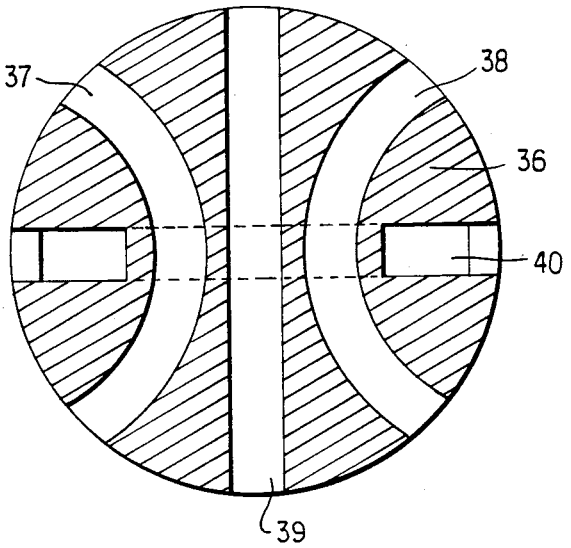
FIG. 6 (PRIOR ART)
Figure 7:
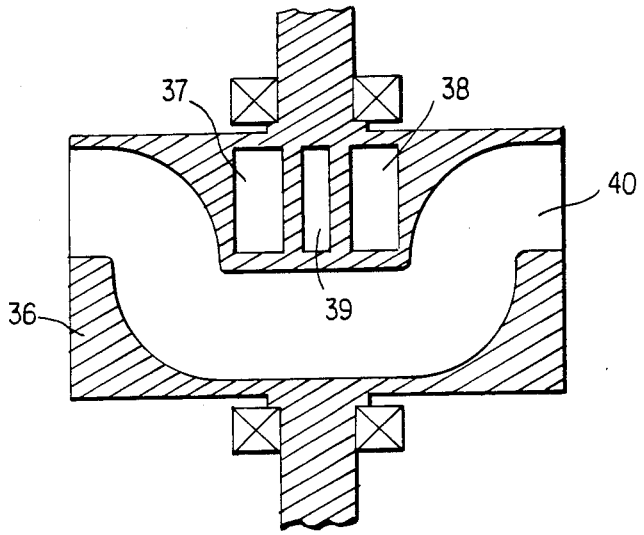
FIG. 7 (PRIOR ART)
Figure 8:
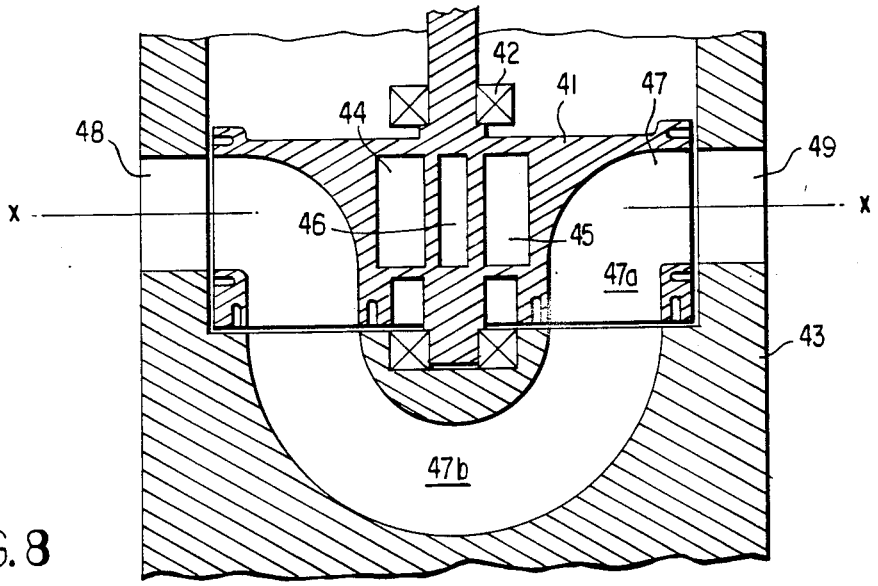
FIGS. 8 and 9 are schematic longitudinal and transverse sections respectively of switching apparatus in accordance with the invention.
Figure 9:
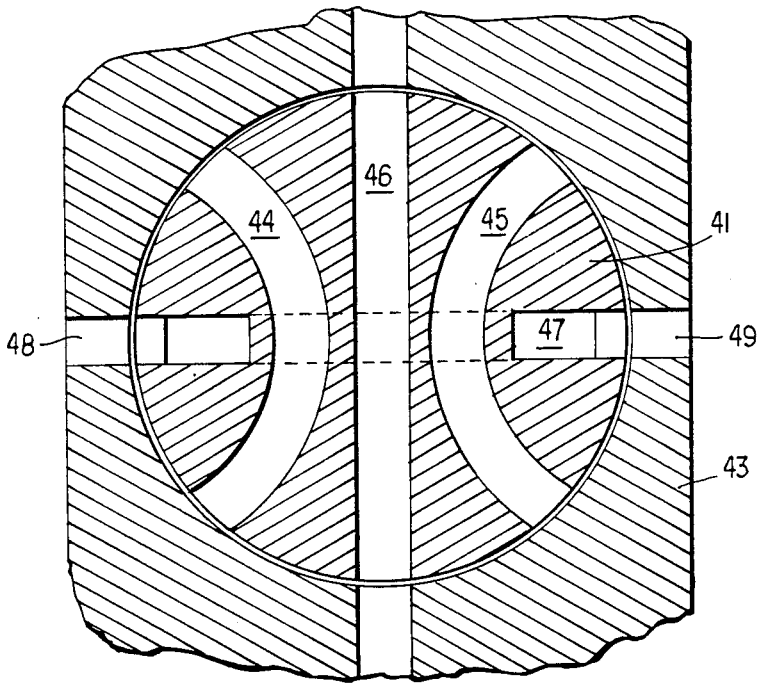

With reference to FIGS. 8 and 9, switching apparatus in accordance with the invention includes a "T" type waveguide switch having a rotor 41 arranged to rotate in bearings 42 relative to a stator 43. The rotor 41 includes two curved passages 44 and 45 to provide connections to waveguide channels in the stator 43, the ports of which are spaced apart by a 90° interval, and a first straight passage 46 across the diameter of the rotor 41. These three passages are contained entirely within the rotor 41. A second passage 47 also provides a straight path which is in a direction normal to that provided by the first mentioned straight passage 46.

However, in this case the passage 47 is a cross-under passage and is arranged to pass beneath the other three passages 44, 45 and 46. The passage 47 is not contained entirely within the rotor 41 but includes a portion 47*a* within the rotor 41 and another portion, 47*b*, located in the stator 43 the passage 47 being so defined by the rotor 41 and stator 43 when they are in a particular position relative to one another. Thus, in the position illustrated, the cross-under passage 47 connects waveguide channels 48 and 49 in the stator 43. As the rotor 41 rotates from the position illustrated, the ports of the cross-under passage 47 go out of alignment with channels 48 and 49 and the portion 47*a* becomes misaligned with the portion 47*b* in the stator. Since only part 47*a* of the passage 47 is included in the rotor 41, this enables the moment of inertia to be greatly reduced over what would be required for a conventional "T" type switch having similar passage dimensions. This reduction in size also enables the clearance required between the rotor 41 and the stator 43 to be reduced, since expansion due to heating effects is also less.

Figure 10:
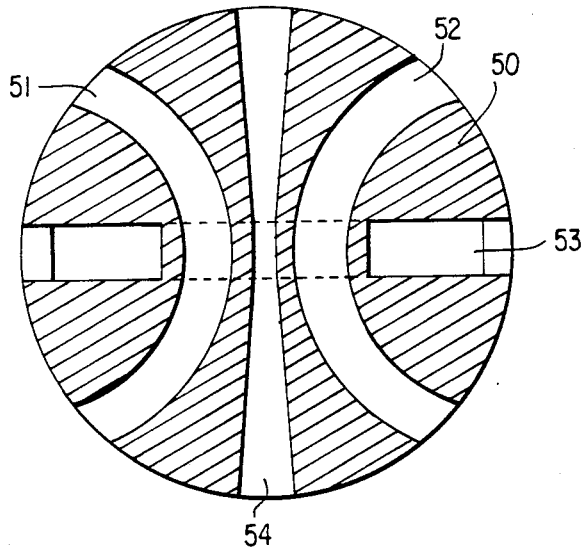
FIG. 10 is a transverse section of part of another switching apparatus in accordance with the invention.

With reference to FIG. 10, in another embodiment of the invention, a waveguide switch includes a rotor 50 having two curved passages 51 and 52 therethrough, a cross-under passage 53, part of which is defined by the stator (not shown) and a straight passage 54 located along a diameter of the rotor 50. The straight passage 54 has a transverse dimension which is greater at its ports than at its centre to give a curved, "waisted" configuration. This enables the two curved passages 51 and 52 to be located closer to one another than would be possible with a conventional straight-sided passage, and thus the diameter of the rotor 50 is reduced compared to a conventional "T" type rotor. By altering the transverse dimension of the passage 54 along its length, the losses in it may also be modified such that they are made substantially equal to those of the curved passages 51 and 52. Thus, any position of the rotor 50 tends to result in similar power losses in the device, enabling the design of the circuitry to be optimized.

Figure 11:
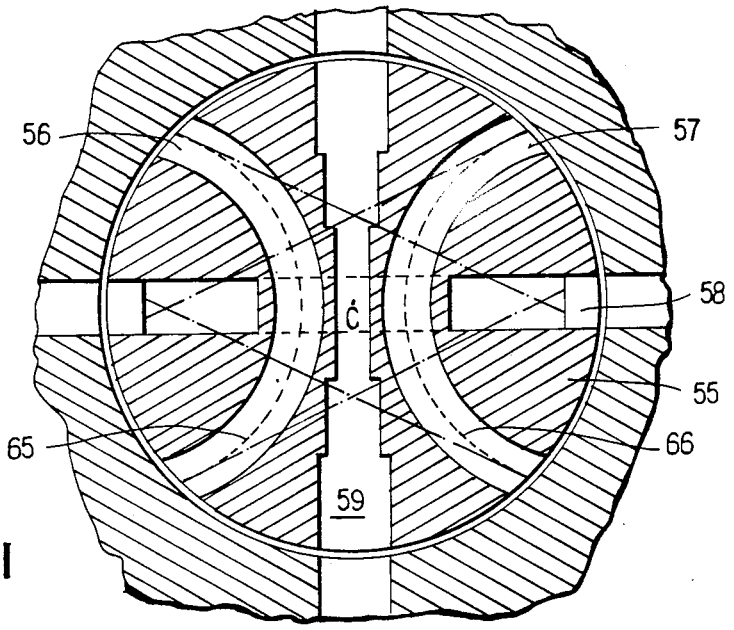
FIG. 11 is a transverse section of part of a further switching apparatus in accordance with the invention.
Figure 12:
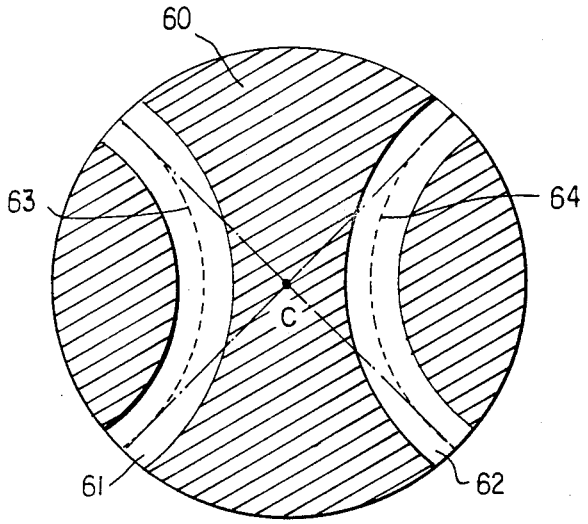
FIG. 12 (PRIOR ART)
FIG. 12 is an explanatory diagram relating to FIG. 11.

With reference to FIG. 11, switching apparatus in accordance with the invention includes a rotor 55 for a "T" type switch having a plurality of passages therein, two curved passages 56 and 57, a cross-under passage 58 which is defined partly by the stator, and a straight passage 59 orthogonal to the cross-under passage and contained wholly within the rotor 55. The straight passage 59 has stepped sides, its transverse dimension at its mid-point being smaller than that at its ports. In the rotor 60 of a conventional "T" type switch, as illustrated in FIG. 12, with only the curved passages 61 and 62 being shown, tangents to their centre-lines 63 and 64 at their ports are radially extending and intersect at the centre of the rotor. However, in the embodiment of the invention shown in FIG. 11, the tangents of the centre-lines 65 and 66 of the curved passages 56 and 57 at their ports intersect beyond the centre C of the rotor 55, being non-radially extending. This configuration has the advantage that a larger proportion of the rotor area is available for accommodation of the cross-under passage 58, enabling the diameter of the rotor 55 to be reduced compared to that of a conventional rotor. There is some discontinuity between the waveguide channels in the stator portion where they connect with the curved passages 56 and 57 in the rotor 55. However, this is compensated for by the extra length of the passage.

Figure 13:
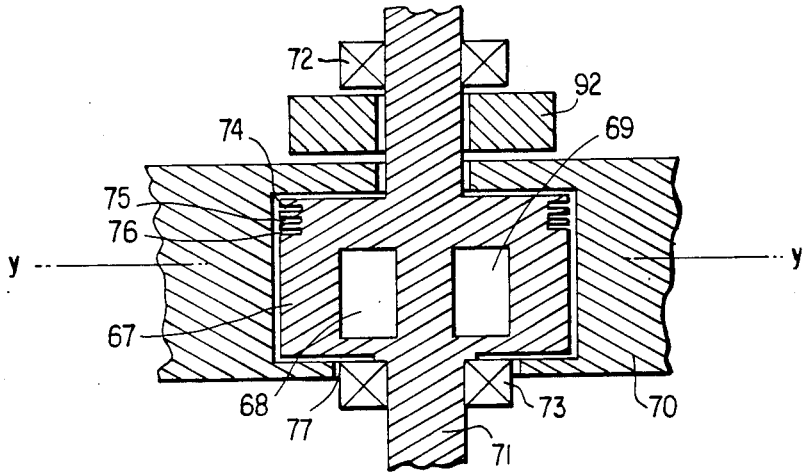
FIGS. 13 and 14 are schematic longitudinal sections of respective apparatus in accordance with the invention.

With reference to FIG. 13 an 'S' type switch in accordance with the invention includes a rotor 67 having two curved passages 68 and 69 therein and is rotatable relative to a stator 70. The rotor 67 includes a shaft 71 along its axis of rotation and is arranged to rotate in bearings 72 and 73, the bearings 72 on one side of the transverse centre plane Y—Y of the rotor 67 being located at a greater distance from the centre plane than the bearings 73 on the other side. Three circumferential slots 74, 75, 76 are located about the rotor 67 on the same side of the plane Y—Y as the bearings 72. These slots 74, 75 and 76 act as a choke to microwave energy travelling through the passages 68 and 69. The slot 76 which is nearest the transverse centre plane Y—Y of the rotor 67 is substantially the same distance from it as the gap 77 between the bottom as shown, of the rotor 67, and the stator 70 on the other side of the centre plane Y—Y. The other two circumferential slots 74 and 75 are such that their effect on microwave energy propagated along the passages 68 and 69 is the same as would be experienced by arranging the bearings 72 to be the same distance from the transverse centre plane Y—Y as the bearings 73. Thus the rotor 67 is made effectively symmetrical about the plane Y—Y, as is generally desirable, in terms of its microwave performance. The provision of an asymmetric circumferential slot arrangement thus permits the bearings 72 to be located at a more convenient distance from the plane Y—Y, permitting an actuator armature 92, for example, to be located between the bearings 72 and the part of the rotor 67 housing the passages 68 and 69.

Figure 14:
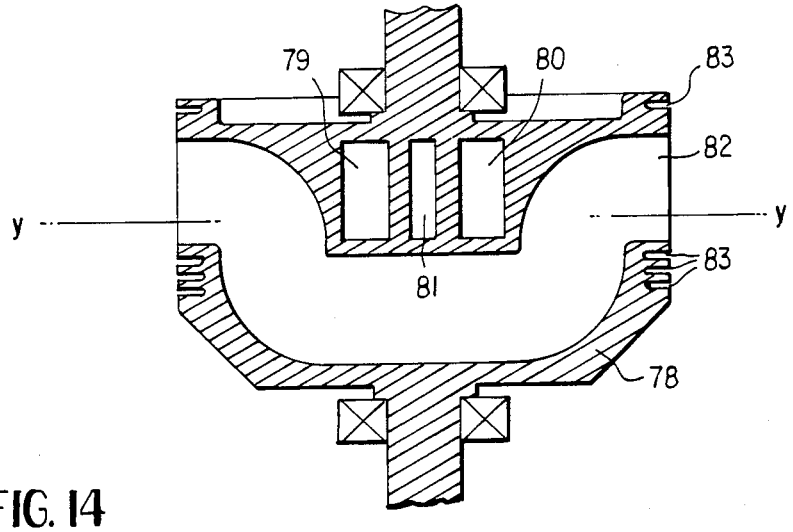

With reference to FIG. 14, another waveguide switching apparatus in accordance with the invention includes a rotor 78 of a "T" type switch which includes curved passages 79 and 80, a straight passage 81 arranged along a diameter of the rotor 78 between them, and a further cross-under passage 82 which has ports in the same plane as those of the other passages 79, 80 and 81 and orthogonal to those of the straight passage 81. Such a rotor is inherently asymmetric about its transverse centre the plane Y—Y because of the arrangement of the passages within it, but by including an asymmetric circumferential slot arrangement 83 compensation may be made, so that the microwave properties of the device on either side of its transverse plane Y—Y are substantially identical.

Figure 15:
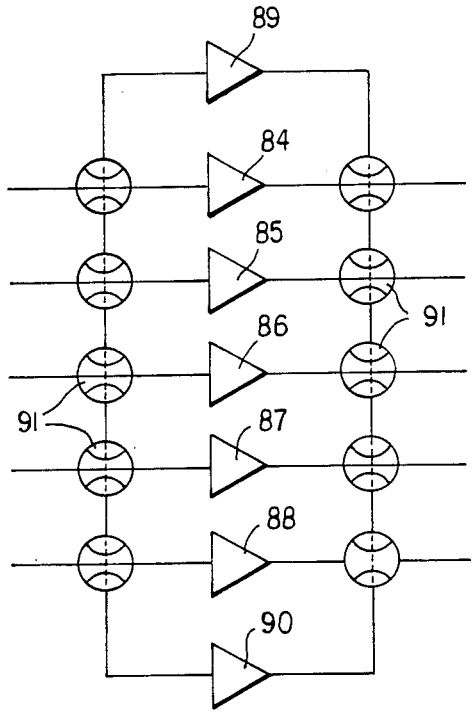
FIG. 15 is a switching arrangement in accordance with the invention.

FIG. 15 illustrates a microwave amplifying arrangement for use in a satellite which includes five main amplifiers 84, 85, 86, 87 and 88, two spare amplifiers 89 and 90 and ten "T" switches 91 in accordance with the invention.

If a failure occurs in one of the main amplifiers 84 to 88 only two switching operations are required to switch a spare amplifier into the circuit to replace it.

If a further failure then occurs a maximum of four switching operations are required to include the other spare amplifier.

We claim:

1. Waveguide switching apparatus comprising first and second members arranged to undergo relative rotation, there being first and second channels in the second member having respective ports at a boundary between the first and second members, the arrangement and construction of the two members being such that, when in a particular position relative to one another, they define a passage between the ports which connects the channels and which is located wholly within the first and second members, part of the passage being located in the first member and part of the passage being located in the second member.

2. Apparatus as claimed in claim 1 including a second passage located entirely within the first member and discrete from, and in a crossing relationship with, the first-mentioned passage.

3. Apparatus as claimed in claim 1 and including a curved passage in said first member having ports at said boundary, the passage being arranged such that tangents to its centre line at its ports extend non-radially.

4. Apparatus as claimed in claim 1 including a passage in said first member which is part of a circle.

5. Apparatus as claimed in claim 1, wherein the first member is a rotor and the second member is a stator.

6. Apparatus as claimed in claim 1 wherein four channels are included in the second member, and the members are constructed and arranged such that connection may be made via passages at least partly located within the first member between any two of the four channels.

7. Apparatus as claimed in claim 6 wherein the four channels have respective ports at the boundary spaced equidistant around the boundary.

8. Apparatus as claimed in claim 1 including a passage through the first member, the passage having a transverse dimension which is designed to be non-uniform along its length.

9. Apparatus as claimed in claim 5 wherein the dimension of the passage is larger at its ports than midway between them.

10. Apparatus as claimed in claim 8, wherein the transverse dimension of the passage through the first member is substantially non-uniform.

11. A microwave amplifying arrangement including waveguide switching apparatus comprising a plurality of waveguide switches, each switch comprising first and second members arranged to undergo relative rotation, there being first and second channels in the second member having respective ports at a boundary between the first and second members, the arrangement and construction of the two members being such that, when in a particular position relative to one another, they define a passage between the ports which connects the channels and which is located wholly within the first and second members, part of the passage being located in the first member and part of the passage being located in the second member, the switches being arranged such that one of a plurality of amplifiers can be switched into a circuit in place of another.

12. Waveguide switching apparatus comprising a rotor and a stator arranged to undergo relative rotation, there being a waveguide passage in the rotor, the passage having a transverse dimension which is designed to be non-constant along its length in a plane transverse to the axis of rotation of the rotor.

13. Apparatus as claimed in claim 12 wherein the transverse dimension of the passage is larger at its ports at the surface of the rotor than mid-way between them.

14. Apparatus as claimed in claim 12 wherein the transverse dimension varies in steps.

15. Apparatus as claimed in claim 12, including a second passage in the rotor arranged orthogonal to the first-mentioned passage.

16. Apparatus as claimed in claim 12, wherein the transverse dimension of the passage in the rotor is substantially non-constant.

17. Apparatus as claimed in claim 12 including a waveguide passage in the rotor which is curved in the plane in which the transverse dimension is non-constant.

18. Apparatus as claimed in claim 17 wherein the curved passage is arranged such that tangents to its centre-line at its ports extend non-radially, whereby it encompasses a larger area of the rotor than if said tangents were to extend radially.

19. Apparatus as claimed in claim 18 wherein the curved waveguide passage is part of a circle.

20. Apparatus as claimed in claim 12 including first and second channels in the stator having respective ports at a boundary between the rotor and the stator, the arrangement and construction of the rotor and stator being such that, when in a particular position relative to one another, they define a passage between the ports which connects the channels and which is located partly in the rotor and partly in the stator.

21. Apparatus as claimed in claim 20 and including a passage located entirely within the rotor and discrete from, and in a crossing relationship with, the passage located partly in the rotor and partly in the stator.

22. Apparatus as claimed in claim 21 and wherein the four channels have respective ports at the boundary spaced equidistant around the boundary.

23. Waveguide switching apparatus comprising a rotor arranged to rotate relative to a stator, there being included in the rotor a curved waveguide passage arranged such that tangents to its centre-line at its ports extend non-radially, and such that the curved waveguide passage encompasses a larger area of the rotor than if said tangents were to extend radially.

24. Apparatus as claimed in claim 23 wherein the curved passage is part of a circle.

25. Apparatus as claimed in claim 23 and including a second waveguide passage, part of which is included in the area encompassed by said curved waveguide passage.

26. Apparatus as claimed in claim 23, wherein the tangents to the centre-line at the ports extend substantially non-radially.

27. Apparatus as claimed in claim 23, including first and second channels in the stator having respective ports at a boundary between the rotor and the stator, the arrangement and construction of the rotor and the stator being such that, when in a particular position relative to one another, they define a passage between the ports which connects the channels and which is located partly in the rotor and partly in the stator.

28. Apparatus as claimed in claim 27 and including a passage located entirely within the rotor and discrete from, and in a crossing relationship with, the passage located partly in the rotor and partly in the stator.

29. Apparatus as claimed in claim 28, further including third and fourth channels in the stator having respective ports at the boundary between the rotor and the stator, and wherein the respective ports of the four channels are spaced equidistant around the boundary.

30. A microwave amplifying arrangement including waveguide switching apparatus comprising a plurality of waveguide switches, each switch comprising a rotor and a stator arranged to undergo relative rotation, there being a waveguide passage in the rotor, the passage having a transverse dimension which is designed to be non-constant along its length in a plane transverse to the axis of rotation of the rotor, the switches being arranged such that one of a plurality of amplifiers can be switched into a circuit in place of another.

31. A microwave amplifying arrangement including waveguide switching apparatus comprising a plurality of waveguide switches, each switch comprising a rotor arranged to rotate relative to a stator, there being included in the rotor a curved waveguide passage arranged such that tangents to its centre-line at its ports extend non-radially, and such that the curved waveguide passage encompasses a larger area of the rotor than if said tangents were to extend radially, the switches being arranged such that one of a plurality of amplifiers can be switched into a circuit in place of another.

32. Waveguide switching apparatus comprising a rotor, having at least one waveguide passage therethrough, and arranged to rotate about an axis of rotation: a stator having a plurality of waveguide channels therein, the rotor and the stator being arranged to relatively rotate and connection via said passage being made between respective waveguide channels depending on the relative position of the rotor and stator; and a circumferential slot arrangement included in a surface of the rotor in which ports of the passage are located, said arrangement being asymmetric about the centre plane of the rotor transverse to said axis of rotation.

33. Apparatus as claimed in claim 32 wherein more circumferential slots are arranged on one side of said centre plane than on the other side.

34. Apparatus as claimed in claim 32 wherein a circumferential slot of said arrangement is continuous.

35. Apparatus as claimed in claim 32 wherein said rotor is physically asymmetric about said centre plane.

36. Apparatus as claimed in claim 32, wherein the stator surrounds the rotor.

37. Apparatus as claimed in claim 32 including bearing means in which said rotor is arranged to rotate, said bearing means including first bearings and second bearings located on respective different sides of said centre plane, said first bearings being located at a greater distance from said centre plane than said second bearings.

38. Apparatus as claimed in claim 32 and including actuator means for moving the rotor located between said first bearings and said centre plane.

* * * * *